US010010171B2

(12) United States Patent
Neste

(10) Patent No.: US 10,010,171 B2
(45) Date of Patent: Jul. 3, 2018

(54) CANTILEVER SYSTEM AND BRACKET FOR A CANTILEVER SYSTEM

(71) Applicant: SUOMENSELÄN JAUHEMAALAUS OY, Visuvesi (FI)

(72) Inventor: Jouni Neste, Visuvesi (FI)

(73) Assignee: SUOMENSELÄN JAUHEMAALAUS OY, Visuvesi (FI)

( * ) Notice: Subject to any disclaimer, the term of this patent is extended or adjusted under 35 U.S.C. 154(b) by 0 days.

(21) Appl. No.: 15/109,657

(22) PCT Filed: Jan. 2, 2015

(86) PCT No.: PCT/FI2015/050002
§ 371 (c)(1),
(2) Date: Jul. 4, 2016

(87) PCT Pub. No.: WO2015/101720
PCT Pub. Date: Jul. 9, 2015

(65) Prior Publication Data

US 2016/0331130 A1 Nov. 17, 2016

(30) Foreign Application Priority Data

Jan. 3, 2014 (FI) ..... 20140003

(51) Int. Cl.
*A47G 29/02* (2006.01)
*A47B 57/34* (2006.01)
(Continued)

(52) U.S. Cl.
CPC ..... *A47B 57/34* (2013.01); *A47B 57/565* (2013.01); *A47B 96/061* (2013.01); *A47B 96/14* (2013.01); *A47B 96/1466* (2013.01)

(58) Field of Classification Search
CPC ..... A47B 96/061; A47B 96/027; A47B 96/06; A47B 57/42; A47B 96/028; A47B 96/067;
(Continued)

(56) References Cited

U.S. PATENT DOCUMENTS 3,888,440 A * 6/1975 Rebentisch ..... H02G 3/263 248/222.13
4,103,855 A * 8/1978 Grosse ..... A47B 57/56 108/108
(Continued)

FOREIGN PATENT DOCUMENTS

DE 2737973 A1 3/1978
EP 0 751 599 A1 1/1997
(Continued)

OTHER PUBLICATIONS

International Search Report for PCT/FI2015/050002, dated May 6, 2015.
(Continued)

*Primary Examiner* — Steven M Marsh
(74) *Attorney, Agent, or Firm* — Fisherbroyles, LLP; Robert Kinberg

(57) ABSTRACT

A cantilever system includes at least one profile rail and at least one bracket for installation in the profile rail. The profile rail includes an elongated opening for the bracket and opposing counter-surfaces inside the profile rail for pulling and pushing caused by the bracket when installed on the profile rail. The bracket includes a widening to be fitted inside the profile rail arranged to form a pulling surface for creating the pulling when the bracket is installed in the opening in the profile rail, and a pushing surface for creating the pushing when the bracket is installed in the opening in the profile rail. The cross-section of the bracket is arranged, in the part that is outside the profile rail, to be at least locally
(Continued)

a sideways opening U-profile, when the bracket is installed in the profile rail. The bracket is manufactured from a single plate piece by bending.

22 Claims, 7 Drawing Sheets

(51) Int. Cl.
*A47B 57/56* (2006.01)
*A47B 96/06* (2006.01)
*A47B 96/14* (2006.01)

(58) Field of Classification Search
CPC .... A47B 96/063; A47B 96/068; A47B 57/045
USPC ..... 248/235, 241, 243, 244; 108/106, 108; 211/187
See application file for complete search history.

(56) References Cited

U.S. PATENT DOCUMENTS 4,299,368 A 11/1981 Winkler
4,674,723 A 6/1987 Bayuk
4,720,069 A * 1/1988 Bessinger ..... A47B 96/061 211/90.01
4,901,965 A * 2/1990 Bowman ..... A47B 57/56 108/108
5,318,264 A * 6/1994 Meiste ..... A47B 57/56 108/108
5,364,052 A * 11/1994 De Gruttis ..... A47B 57/565 108/108
5,806,820 A 9/1998 Simon
8,770,553 B2 * 7/2014 Van Es ..... E04H 17/1434 256/65.08
2011/0272549 A1 * 11/2011 Benz ..... A47B 57/562 248/244

FOREIGN PATENT DOCUMENTS

FR 1 303 172 A 9/1962
GB 671161 A 4/1952
GB 846 928 A 9/1960
JP S53 79124 U 7/1978

OTHER PUBLICATIONS

Written Opinion for PCT/FI2015/050002, dated May 6, 2015.
Supplementary European Search Report, dated Jul. 21, 2017, for related EP Application No. 15733197.6.

* cited by examiner

CANTILEVER SYSTEM AND BRACKET FOR A CANTILEVER SYSTEM

CROSS-REFERENCE TO RELATED APPLICATIONS

This application is a U.S. National Stage Application of International Patent Application No. PCT/FI2015/050002, filed Jan. 2, 2015, which claims benefit of Finland Patent Application No. 20140003, filed Jan. 3, 2014.

TECHNICAL FIELD

The present invention relates to a cantilever system, which includes

- at least one profile rail, in which is arranged to be installed
  - at least one bracket and which profile rail includes
  - a elongated opening for the bracket,
  - opposing counter-surfaces arranged inside the profile rail for pulling and pushing, which the bracket is arranged to cause when installed on the profile rail,
- at least one bracket, which includes
  - a widening to be fitted inside the profile rail, which is arranged to form a pulling surface for creating the said pulling when the bracket is installed in the opening in the profile rail,
  - a pushing surface for creating the said pushing when the bracket is installed in the opening in the profile rail.

The invention also relates to a bracket for a cantilever system.

BACKGROUND OF THE INVENTION

Several different cantilever systems are known from the prior art, in which, for example, a bracket supporting a shelf is attached to an elongated rail. Brackets with a U-shaped cross-section opening upwards, for example, are known. However, a general problem with them is that the screws used to attach the shelf must be of different length, because the U-bracket is designed to narrow outwards. In addition, in several known systems, there are standard locations in the rail for the brackets, which limits their installation to discrete positions.

Brackets that are steplessly adjustable in the rails are also known. One example of these is disclosed in U.S. Pat. No. 4,156,515. However, the bracket presented in it is relatively difficult and expensive to manufacture. In addition, shelves, for example, are difficult to attach to the bracket presented here. Yet another challenge relating to this bracket is to make it remain firmly in place.

SUMMARY OF THE INVENTION

The present invention is intended to create a cantilever system, which is economical and simple to manufacture, and which is simple in construction, but nevertheless strong. The cantilever system according to the invention is characterized by a cantilever system, comprising at least one profile rail, in which is arranged to be installed at least one bracket and which profile rail comprises an elongated opening for the bracket and opposing counter-surfaces arranged inside the profile rail for pulling and pushing, which the bracket is arranged to cause when installed on the profile rail and at least one bracket manufactured from a single plate piece by bending, comprising a widening to be fitted inside the profile rail, which is arranged to form a pulling surface for creating the said pulling when the bracket is installed in the opening in the profile rail and a pushing surface for creating the said pushing when the bracket is installed in the opening in the profile rail, wherein the cross-section of the bracket is arranged, in the part that is outside the profile rail, to be at least locally a sideways opening U-profile, when the bracket is installed in the profile rail.

In addition, another object of the invention is to provide a bracket for a cantilever system, which bracket can be installed in a profile rail, the profile rail comprising an elongated opening for the bracket and opposing counter-surfaces arranged inside the profile rail for pulling and pushing, which the bracket is arranged to create when installed in the profile rail, wherein the bracket is manufactured from a single plate piece by bending and comprising a widening to be fitted inside the profile rail, which is arranged to form a pulling surface for creating the said pulling when the bracket is installed in the opening in the profile rail and a pushing surface for creating the said pushing when the bracket is installed in the opening in the profile rail and wherein the cross-section of the bracket is arranged, in the part that is outside the profile rail, to be at least locally a sideways opening U-profile when, the bracket is installed in the profile rail.

Thanks to the invention, the bracket is simple in construction and manufacture, but nevertheless strong. In addition, objects to be supported can also be easily attached to the bracket.

According to one embodiment, the U-profile of the bracket can be formed of an upper flange, a lower flange, and a web arranged between them. According to one embodiment, the lower flange and the profile rail equipped with an opening can be dimensioned in such a way that, when the bracket is installed in the profile rail, the bracket is arranged to remain in the compression created by the edges of the opening at the lower flange. This ensures that the bracket will remain securely in place even when not loaded.

One way of implementing the compression setup is to arrange a local widening in the lower flange. The widening is arranged in the position of the opening of the profile rail, when the bracket is installed in the profile rail. The local sideways opening U-profile is then to be formed to the area of the widening, which especially when the bracket is loaded becomes stressed. The form of the U-profile and its location at least in the area of the root of the bracket also reinforces the bracket. Particularly the local widening also prevents the lateral buckling of the bracket.

According to one embodiment, a locking mechanism is fitted to the bracket to lock the bracket in place in the profile rail. According to one embodiment, the locking mechanism can be fitted to the widening. By using the locking mechanism, the pulling and pushing surface of the bracket can then be wedged into the profile rail against counter-surfaces arranged for them. The implementation of the locking mechanism is also simple and reliable.

Through the invention, in addition to the system, a strong, economical, and industrially simply manufactured bracket, which can be steplessly and easily adjusted, can also be implemented. The other characteristic features of the invention are stated in the accompanying description and other advantages achieved with the invention are referred to in greater detail in the description portion.

BRIEF DESCRIPTION OF THE DRAWINGS

The invention, which the embodiments described hereinafter in no way restrict, is described in greater detail reference to the accompanying figures, in which.

DETAILED DESCRIPTION OF THE INVENTION

Figure 1:
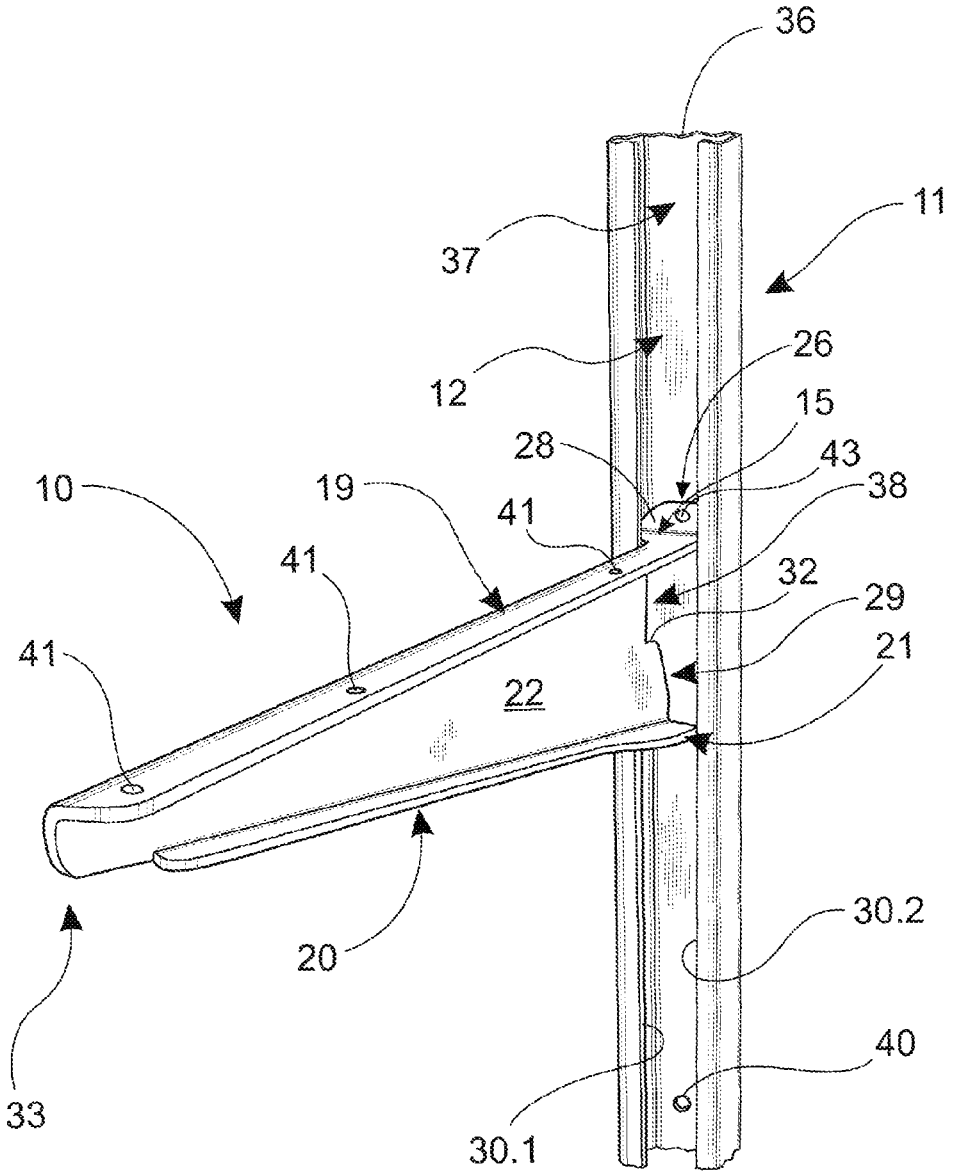
FIGS. 1 and 2 show an example of the basic components of the cantilever system, seen from different directions.
Figure 2:
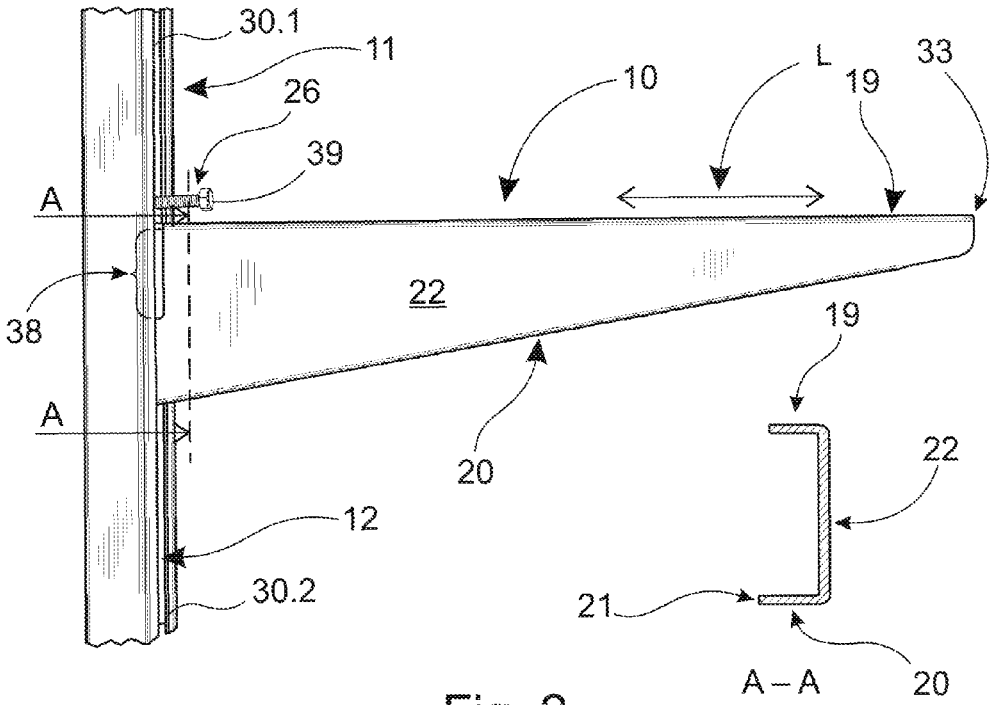

FIGS. 1 and 2 show one example of the basic components of the cantilever system, seen from different directions, and with the components fitted to each other. In FIG. 1, the system is shown at an angle from in front and in FIG. 2 seen from the side. The cantilever system includes, as basic components, at least one profile rail 11 and at least one bracket 10. The bracket 10 can, at one end, be detachably and, in addition, also moveably installed in the profile rail 11. In other words, the location of the bracket 10 in the profile rail 11 can be changed longitudinally.

Figure 3:
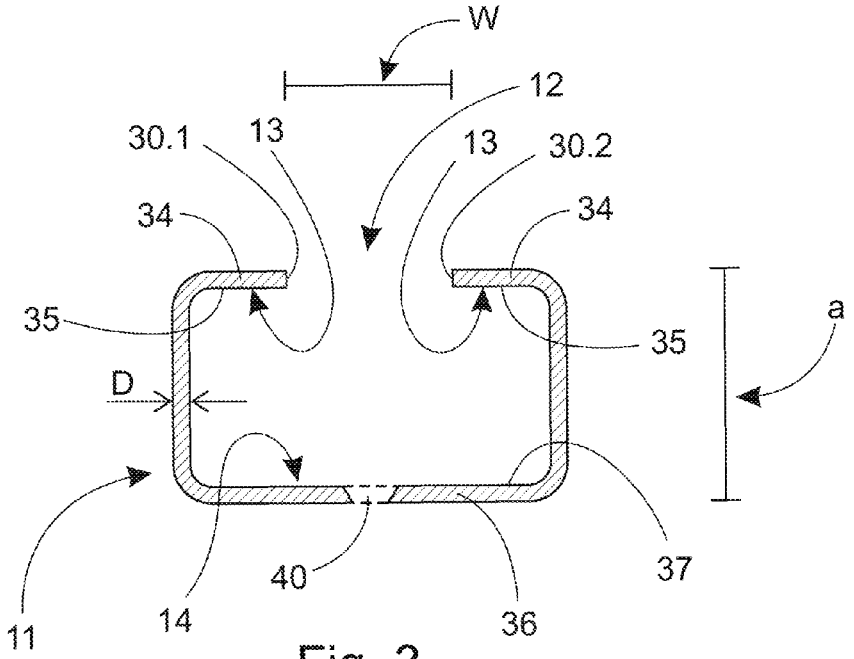
FIG. 3 shows an example of the profile rail, seen as an end cross-section.

For its part, FIG. 3 shows an example of the profile rail 11 seen as an end cross-section, without the bracket 10. A hollow elongated tubular beam profile is shown as an example of the profile rail 11. This includes an elongated opening 12 arranged for the bracket 10 longitudinally in one of the sides of the profile rail 11. The cross-section of the profile rail 11 then forms a C-profile cut open on one side. The profile rail 11 includes front walls 34 on both side relative to the opening 12, a rear wall 36 on the opposite side relative to the open front walls 34, and side walls between the front walls 34 and the rear wall 36.

The rear wall 36 of the profile rail 11 can include, for example, holes 40, through which the profile rail 11 can be attached to the wall at its installation location, for example, with screws. The inner and outer surfaces of the profile rail 11 can be mainly smooth, without special shapings or other openings. The profile rail 11, which can be attached to a wall and acts as an attachment rail for the bracket 10, is, in construction and manufacture, simple, economical, and strong enough that it can, if necessary, also be free-standing. The material thickness D of the wall of the profile rail 11, and its opening 12, is arranged to be such that they are mainly non-deforming, when, for example, the loading caused by the bracket 10 acts upon them. Thus, permanent deformation, buckling, or crinkling does not take place in the profile rail 11.

The profile rail 11 includes opposing counter surfaces 13, 14 arranged inside it for the arranged pulling and pushing caused by the bracket 10, which the bracket 10 is arranged to cause when installed in the profile rail 11 and loaded. The pulling and pushing caused by the bracket 10 in the profile rail 11 are forces in opposite directions, which are caused by the loading acting on the bracket 10. The inner surface 35 of the front walls 34 of the profile rail 11 is arranged to form a counter-surface 13 for the pulling arranged to be caused on the front wall 34 by the bracket 10. The pulling is caused by a loading directed to the bracket 10, which pulls the front wall 34. The counter-surface 13 is formed against the inner surface 35 of the walls 34 arranged on both sides of the opening 12. Correspondingly, the inner surface 37 of the rear wall 36 of the profile rail 11, which is opposite to the inner surface 35 of the front wall 34, is arranged to form a counter-surface 14 for the pushing arranged to be caused to the bracket 10. When the bracket 10 is loaded, pushing is correspondingly directed to the rear wall 36 of the profile rail 11.

In other words, the bracket 10 can be considered to be functionally a beam loaded from above, which is attached at its end to the profile rail 11. Tension can then be considered to be directed to the upper part of the beam and compression correspondingly to the lower part. Thus, pushing creates compression caused by the bracket 10 against the inner surface 37 of the rear wall 36 of the profile rail 11 and pulling creates compression caused by the bracket 10 against the inner surfaces 35 of the front walls 34 of the profile rail 11. The mainly perpendicular forces of the counter surfaces create a friction force, which holds the bracket 10 in place in the longitudinal direction of the profile rail 11, so that the bracket 10 cannot slide along the counter surfaces.

Figure 4:
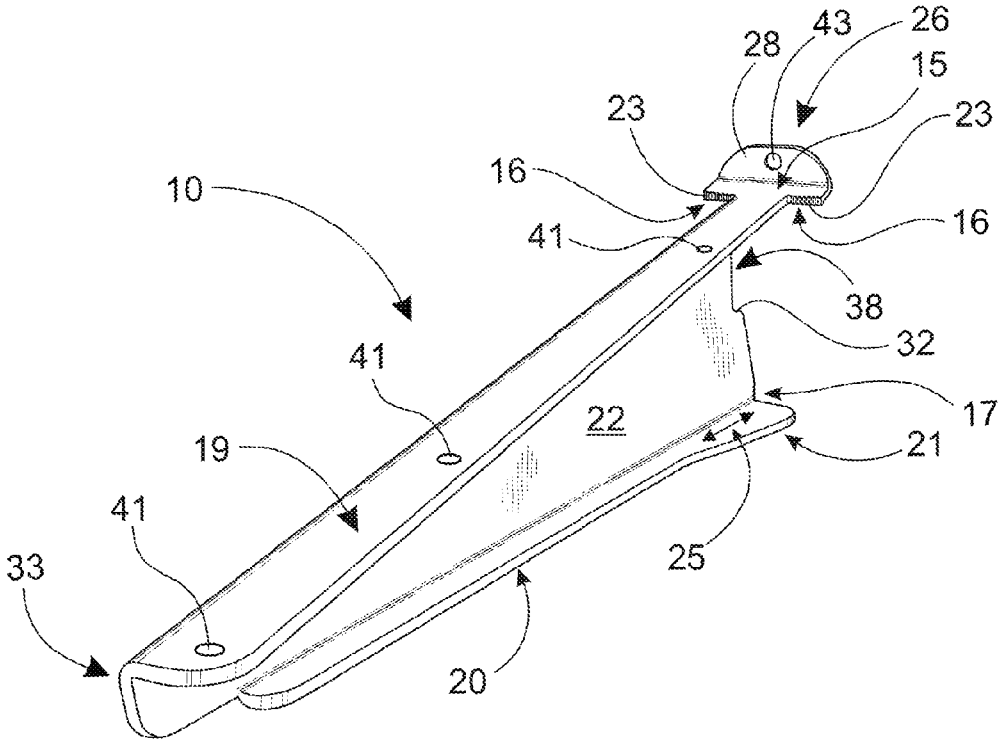
FIGS. 4 and 5 show one example of the bracket, seen from different directions.
Figure 5:
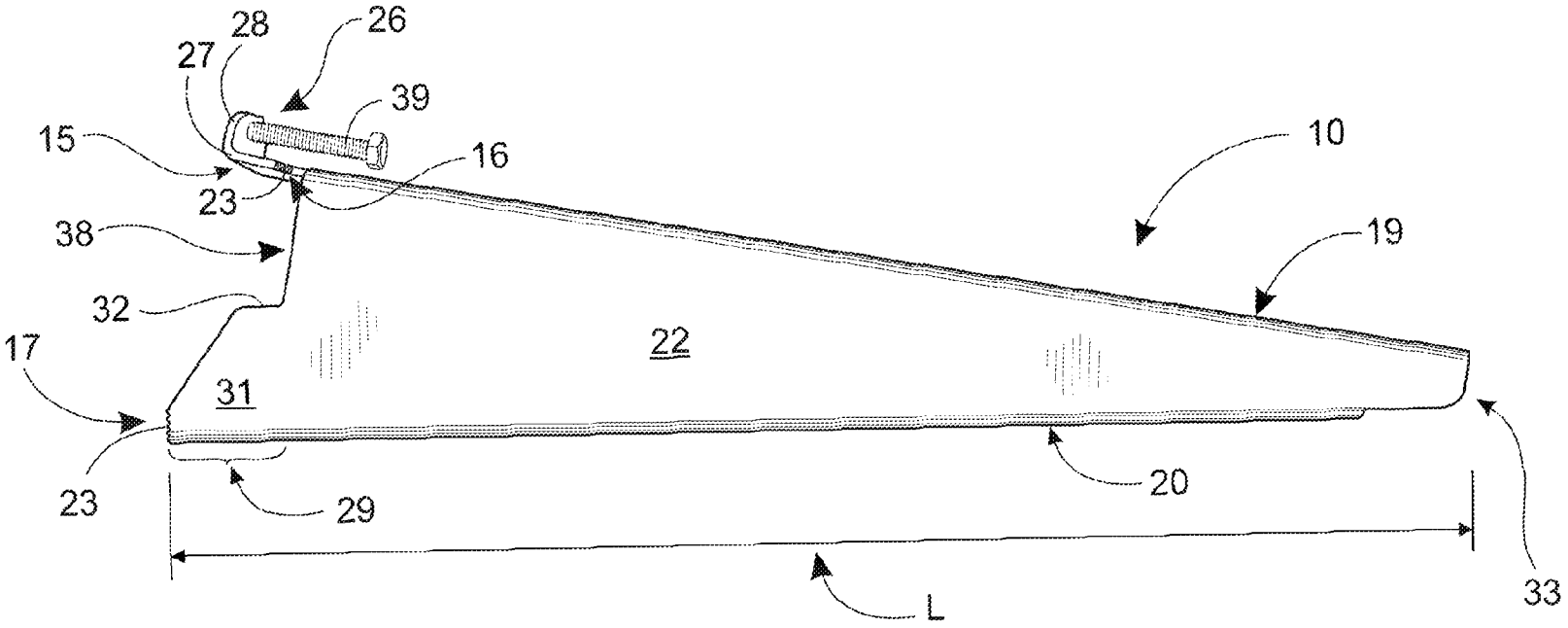

FIGS. 4 and 5 show one example of a bracket 10, seen from different directions and separate from the profile rail 11. In FIG. 4, the bracket 10 is seen at an angle from in front and in FIG. 5 seen from one side. The bracket 10 can, in turn, include a pulling surface 16 supported on the counter-surface 13 of the front wall 34 of the profile rail 11 and a pushing surface 17 supported on the counter-surface 14 of the rear wall 36.

For the formation of the pulling surface 16, the bracket 10 can include a rigid widening 15 to be fitted inside the profile rail 11 in the upper part of the bracket 10 when it is installed in the profile rail 11. The widening 15 is formed of two wings, which spread outside the basic cross-section of the bracket 10. A pulling surface 16 is fitted to the edges of the wings on the side next to the front walls 34, for creating pulling directed to the front wall 34 of the profile rail 11, when the bracket 10 is installed in the opening 12 of the profile rail 11.

Correspondingly, the bracket 10 also includes a pushing surface 17 for creating pushing when the bracket 10 is installed in the opening 12 of the profile rail 11. The pushing surface 17 is in the lower part of the bracket 10 and is directed towards the rear wall 36 of the profile rail 11 when the bracket 10 is installed in the profile rail 11.

The cross-section of the bracket 10 is arranged, in the part that is outside the profile rail 11, to be at least locally a sideways opening U-profile, when the bracket 10 is installed in the profile rail 11. FIG. 2 shows an example of such a cross-section. The U-profile can open sideways when the bracket 10 is installed in the profile rail 11. If the characteristic plane is formed by the front wall 34 of the profile rail 11, then the direction of opening of the U-profile is perpendicular relative to it.

According to one embodiment, the bracket 10 can include an upper flange 19, a lower flange 20, and a web 22 arranged between them, which together form a U-profile opening to the side in the bracket 10, at least at some point in the longitudinal direction L of the bracket 10, when the bracket 10 is installed in the profile rail 11.

As can be seen from FIGS. 4 and 5, the widening 15 is arranged as an extension to the upper flange 19 at the end of the bracket 10 and it can be wider than the upper flange 19. The lower flange 20 is on the opposite side of the bracket 10 and even more particularly of the web 22 relative to the upper flange 19. The lower flange 20 and the upper flange 19 are next to each other over at least part of the longitudinal length L of the bracket 10. The lower flange 20 is fitted to the bracket 10 at least for the part outside of the profile rail 11 when the bracket 10 is installed in the profile rail 11.

Together the upper flange 19, the lower flange 20, and the web 22 between them form at least a local U-profile for the bracket 10. Here the term local U-profile refers to the fact that the upper flange 19, the web 22, and the lower flange 20 form, at least some part of the bracket 10 protruding from the profile rail 11, a bracket 10 with a U-profile cross-section. The U-profile opens sideways when the bracket 10 is installed in the profile rail 11. The upper and lower flanges 19, 20 are then planar surfaces and point to the same side, the web 22 between them being vertical. The upper flange 19 can be a horizontal surface and the lower flange 20 can be a slightly downwards opening surface.

The cross-section of the bracket 10 can be arranged locally to form a U-profile, for example, at a point, which is on the opposite side of the opening 12 relative to the counter-surface 13 arranged for pulling in the profile rail 11, when the bracket 10 is installed in the profile rail 11. The U-profile can then be said to be at the bracket's 10 root and/or in its vicinity, when the bracket 10 is installed in the profile rail 11. Generally, reference can also be made to the area 25 of the root of the bracket 10. The greatest torsion, shear force, and tension and compression forces act up this area 25, when the bracket 10 is installed in the profile rail 11 and is loaded. The U-profile form of the bracket 10 can continue for even a long distance in the longitudinal direction L of the bracket 10. In the case according to the embodiment, the U-profile form continues nearly to the end of the bracket 10. It can be seen from FIGS. 1 and 4 that the upper flange 19 extends right to the end of the bracket 10 while the lower flange 20 remains slightly short of the point of the bracket 10, which is opposite to the end that is to be attached to the profile rail 11. In this case, the bracket 10 has a U-profile cross-section over most of its length L.

The upper flange 19 of the bracket 10 can be equipped with holes 41 for carrying, for example, a shelf or other cantilevered object and attaching it to the bracket 10. There can be one or more holes 41 parallel to each other and consecutively in the upper flange 19. The upper flange 19 and the lower flange 20 in addition to it also stiffen the bracket 10.

Figure 7:
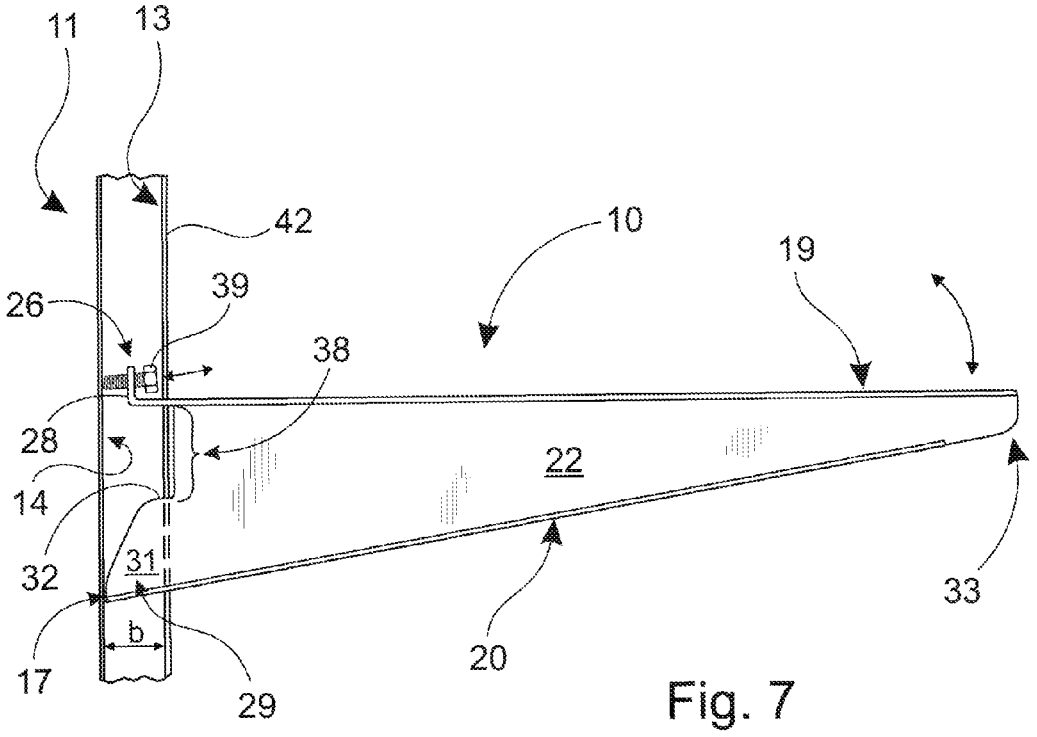
FIG. 7 shows a cross-section of the bracket installed in the profile rail.

According to one embodiment, the width d1 of the upper flange 19 can be greater than the width d2 of the lower flange 20 over most of the length L of the bracket 10 (FIG. 7). The lower flange 20 being narrower than the upper flange 19 it is easy to attach, for example, a shelf or other cantilevered object to the upper flange 19 from directly underneath, for example, using a screw attachment with screws of equal length. The narrower lower flange 20 relative to the upper flange 19 will then not be under attachment's feet. In addition, thanks to the single-web form, it will be easy to hold the attachment when putting it in the hole 41 in the upper flange 19. The holes 41 can be as close as possible to the edge of the upper flange 19, so that the lower flange 20 will be even less in the road. In addition, the farthest hole 41 relative to the profile rail 11 can be in the point 33 of the bracket 10, in such an area of the upper flange 19 where there is no longer the lower flange 20. The local widening 21 of the lower flange 20 can be shaped in such a way that an attachment can also be easily installed in a closer hole 41 in the upper flange 19 relative to the profile rail 11.

If the upper flange 19 is implemented with sufficient width, the bracket 10 can be used to support even two adjacent shelves at the seam point, without separate widenings or similar support pieces being required on top of the bracket 10. There can then be double holes in the upper flange 19. The upper flange 19 can be wider or narrower than the opening 12 in the profile rail 11. In addition, the height of the cross-section of the bracket 10 can diminish the farther it is from the profile rail 11, when the bracket 10 is installed in the profile rail 11.

Figure 6:
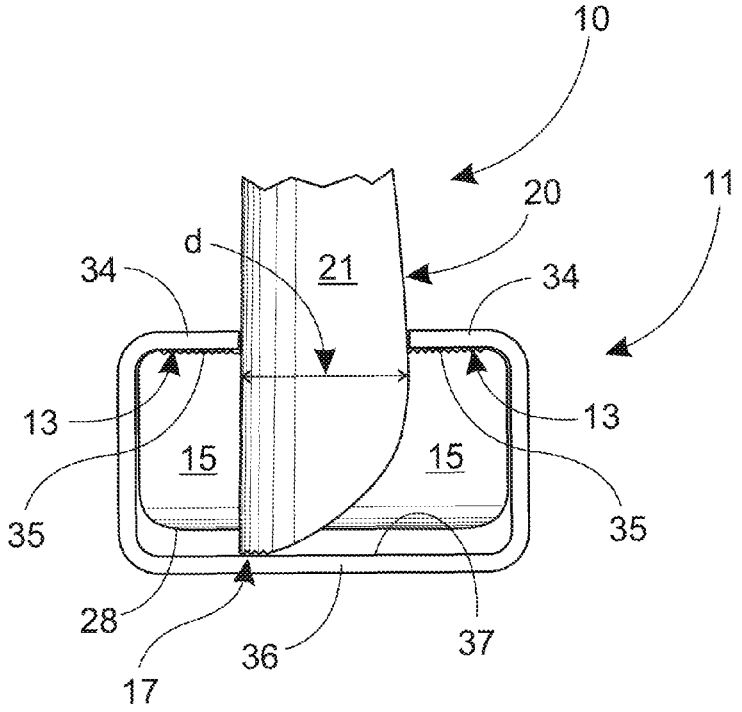
FIG. 6 shows a bottom view of the bracket installed in the profile rail.

FIG. 6 shows a bottom view of the bracket 10 installed in the profile rail 11. According to one embodiment, the lower flange 20 of the bracket 10 joining the web 22 and the profile rail 11 equipped with an opening 12 can be dimensioned in such a way that, when the bracket 10 is installed in the profile rail 11 the bracket 10 is arranged to remain in compression formed by the edges 30.1, 30.2 of the opening 12 at the lower flange 20. This makes the lateral installation of the bracket 10 more sturdy. In addition, this also prevents the unintentional detaching of the installed bracket 10 from the profile rail 11. The lower flange 20 is compressed between the edges 30.1, 30.2 of the front walls 34 of the profile rail 11, when the bracket 10 is installed in the profile rail 11. Force is required to detach it from here. The lower flange 20 of the bracket 10 can include a local widening 21 in the end of the bracket 10 attached to the profile rail 11. The widening 21 is arranged at the location of the opening 12 of the profile rail 11, when the bracket 10 is installed in the profile rail 11. The local widening 21, which can be greater relative to the basic width of the lower flange 20, stiffens the bracket 10 particularly in the area 25 at its root, to which the greatest strain is directed when loaded. The local widening 21 can also be utilized in forming compression between the bracket 10 and the edges 30.1, 30.2 of the opening 12. Thus, the local widening 21 can be the part of the lower flange 20 that is gripped by the opening 12, when the bracket 10 is installed in the profile rail 11 or is being installed in the profile rail 11.

The width d of the widening 21 can be equal to the width W of the opening 12 in the profile rail 11 or be slightly wider than it. The widest point on the widening 21 can be set inside the profile rail 11 in the lower position of the bracket 10. The opening 12 must then be slightly spread, to allow the lower part of the bracket 10 to be turned out of the profile rail 11, i.e. lifted free of it. This is achieved using an intentional amount of force, nor will the bracket 10 then be able to be unintentionally released. In other words, the widening 21 arranged in the lower flange 20 of the bracket 10 causes horizontal elastic tension between the edges 30.1, 30.2 of the front walls 34 of the profile rail 11, which the friction force created against the widening 21 of the bracket 10 prevents the lower part of the bracket 10 from rotating laterally, and thus unintentionally moving and releasing of the bracket 10. The bracket 10 cannot open the opening 12 of the profile rail 11 more than the widening 21 of the lower flange 20 opens it when entering the profile rail 11.

The local U-profile form of the cross-section of the bracket 10 referred to above in the description can be implemented as referred to above at least in the area 25 of the root of the bracket 10. According to one embodiment, this area 25 can correspond to, for example, the area of the local widening 21, according to FIG. 4. Thus the U-profile form of the cross-section of the bracket 10 can be implemented over only a very short portion of the total length of the bracket 10. On the other hand, when the bracket 10 is very short, its cross-section can be a U-profile over most or all of the length of the bracket 10.

As can also be seen from FIG. 6, the lower flange 20 can also be arranged to extend inside the profile rail 11, when the bracket 10 is installed in the profile rail 11. This will for its part also stiffen the bracket 10. In addition, this part of the lower flange 20 can be used as a guiding surface for the local widening 21, by shaping it smoothly. This will facilitate the installation of the bracket 10 in the profile rail 11.

FIG. 7 shows a cross-section of the bracket 10 installed in the profile rail 11. The pulling surface 13 of the bracket 10 and its pushing surface 14 and the corresponding counter-surfaces 16, 17 arranged for these in the profile rail 11 are arranged to permit the stepless adjustment of the bracket 10 in the profile rail 11. The bracket 10 can then be installed and supported from the profile rail 11 at any point at all in the profile rail 11. In the upper edge of the bracket 10 there is a widening 15 acting as a pulling surface 16 supported on the front wall 34 of the profile rail 11 and in the lower edge of the bracket 10 a sharp pushing surface 17 supported on the rear wall 36 of the profile rail 11. The horizontal distance b between the pulling and pushing surfaces 16, 17 can be the same as or different to the internal dimension a of the profile rail 11 (FIG. 3). When the dimensions are the same, the bracket 10 takes up a horizontal attitude when installed in the profile rail 11. The location and dimensioning of the pulling and pushing surfaces 16, 17 in the bracket 10 relative to the internal dimensioning of the profile rail 11 are arranged in such a way that, when loaded, the bracket 11 is wedged inside the profile rail 11 by the pulling and pushing surfaces 16, 17.

When the bracket 10 is wedged inside the profile rail 11, a friction effect is formed between the counter-surfaces 13, 14 and the pulling and pushing surface 16, 17 of the bracket 10, which holds the bracket 10 in place when installed in the profile rail 11. For this purpose, the bracket 10 and the locations of the pulling and pushing surfaces 16, 17 fitted to it relative to each other and the internal dimensions of the profile rail 11 are arranged in such a way that the surfaces 13, 14, 16, 17 settle next to each other when the bracket 10 is in the intended installation position in the profile rail 11. The grip can be improved by means of gripping shapings 23 arranged in the pulling and pushing surfaces 16, 17. As an example of these are shown the serrations 24 arranged in the surfaces 13, 14 fitted to the bracket 10.

The bracket 10 can also include a locking mechanism 26 for locking the bracket 10 in place in the profile rail 11 in its longitudinal direction L. By means of the locking mechanism 26 the pulling and pushing surface 16, 17 of the bracket 10 can be wedged against the counter-surfaces 13, 14 arranged for them inside the profile rail 11.

According to one embodiment, the locking mechanism 26 can be fitted to the widening 15 arranged in the upper flange 19 of the bracket 10. One way to arrange the locking mechanism 26 can be to arrange a bend 27 in the widening 15, onto the flange 28 formed by which a locking element 39 is fitted. There is a threaded hole 43 in the flange 28 for the locking element 39.

The locking mechanism 26 operates in such a way that it pushes against the inner surface 37 of the rear wall 36 of the profile rail 11. It then wedges the bracket 10 with the aid of a lever effect from above the level of the widenings 15. The locking mechanism 26 wedges with the aid of the lever effect the bracket's 10 own friction surfaces 16, 17 against the counter-surfaces 13, 14 of the profile rail 11. Once the bracket 10 is locked in place, it cannot be moved in the profile rail 11 without opening the locking mechanism 26. According to the embodiment, a screw, i.e. the locking element 39, pushes against the rear wall 36 of the profile rail 11 above the friction surfaces 16 of the widening 15 arranged in connection with the upper flange 19 of the bracket 10. Alternatively, the locking element 39 can also push against the inner surface 35 of the front wall 34 of the profile rail 11 below the friction surface 17 of the lower part of the bracket 10.

By means of the locking mechanism 26 permanent locking of the bracket 10 is achieved, in such a way that the bracket 10 cannot unintentionally move. However, if required, the locking can be easily removed while adjusting the position of the bracket 10. In addition, the locking is also safe, because its opening, if so desired, will not succeed without tools. If there is no need to adjust the bracket 10, the bracket 10 can also be locked in place in such a way that the shelf board is set against the outer surface 42 of the front wall 34 of the profile rail (FIG. 7), when it will not be possible to lift the lower flange 20 of the bracket 10 out of the opening 12 of the profile rail 11.

As can be seen from FIGS. 5 and 7, an extension 29 of the web 22 protruding inside the profile rail 11 can be fitted to the lower part of the web 22, when the bracket 10 is installed in the profile rail 11. The extension 29 is arranged to form a support surface 31 lying against the first edge 30.1 of the opening 12. The support surface 31 is on the opposite side of the bracket 10 to the lower flange 20. In addition to the upper flange 19 being planar and attached to the shelf, this support surface 31 for its part also ensures that the bracket 10 cannot swing at all laterally when it is installed in the profile rail 11. The support surface 31 prevents particularly the bracket 10 from turning to the side of the opening direction of the U-profile. In addition, stiffness requirements also relate to the extension 29 of the web 22. Shear force is transmitted to the pulling counter-surface through the extension 29 of the web 22.

An edge 32, can be arranged in the web 22 at the location of the local widening 21, and which can be mainly perpendicular relative to the edge 30.1 of the opening 12 of the profile rail 11, when setting the local widening 21 arranged in the bracket 10 to the compression formed by the edges 30.1, 30.2 of the opening 12. The edge 32 is arranged in the extension 29. When the bracket 10 presses inside the profile rail 11 from its lower part, the profile rail 11 causes transverse compression in the lower flange 20 of the bracket 10. By setting the edge 32 perpendicularly relative to the surface of the front side of the profile rail 11 when installing the bracket 10 in the opening 12 of the profile rail 11, the edge 32 causes the perpendicular surface to slide in as straight a line as possible, thus forming a sliding surface. By means of the edge 32 the formation of a disadvantageous slanting shear surface is avoided, which might interfere with the installation of the bracket 10 in the profile rail 11.

The part 38 of the web 22 between the extension 29 and the widening 15 is arranged to remain outside the profile rail 11 when the bracket 10 is installed in the profile rail 11. Thus the web 22 of the bracket 10 is at least partly arranged to extend to the profile rail 11, i.e. to the area 25 of its root, when the bracket 10 is installed in the profile rail 11. This facilitates the installation of the bracket 10 in the profile rail 11 and also the pressing of the lower flange 20 of the bracket 10 into the opening 12, as well as its removal from the opening 12. The contact area of the web 22 with the edge 30.1 of the opening 12 is then small.

Figure 8:
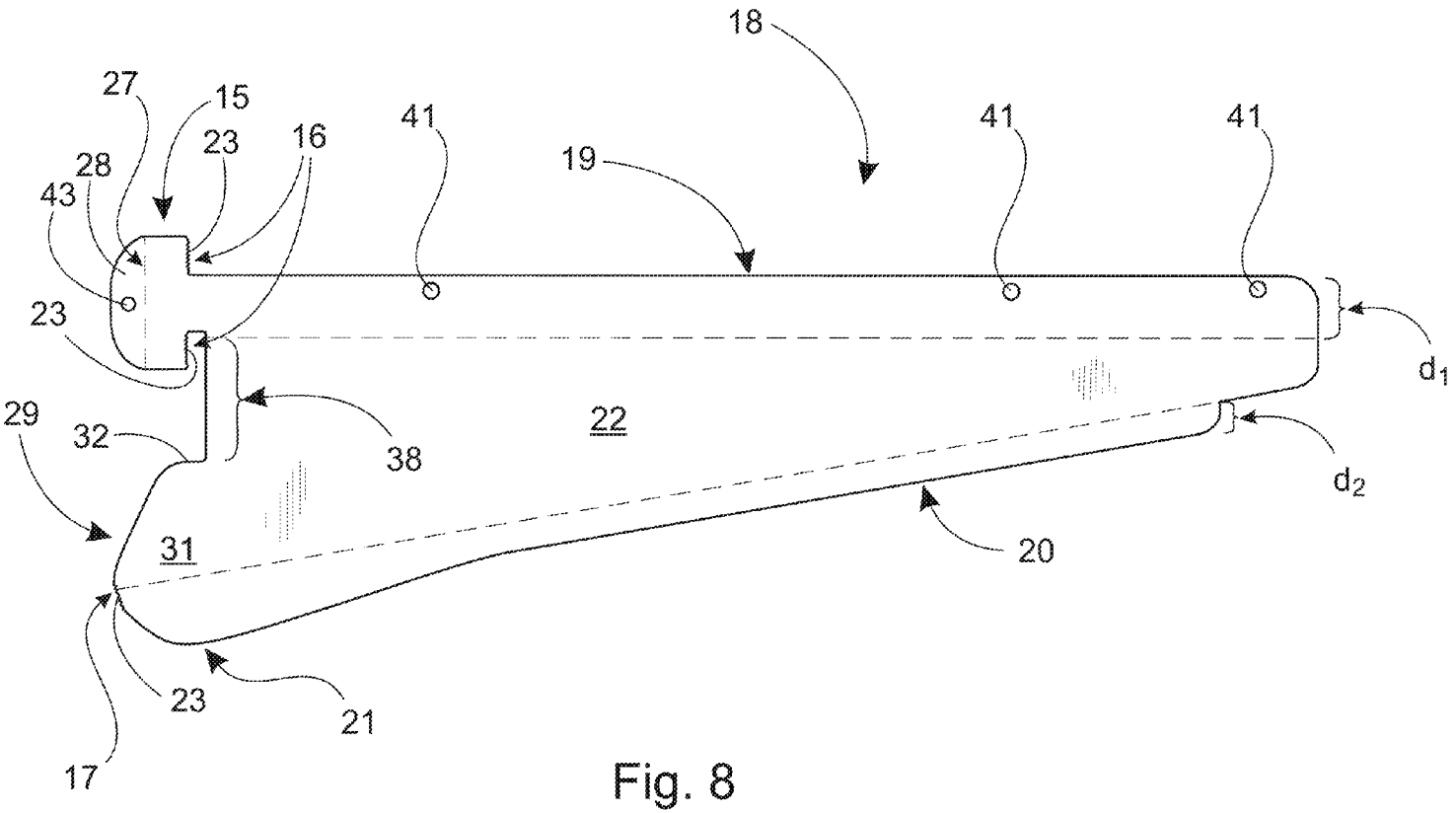
FIG. 8 shows an example of the bracket blank.

FIG. 8 shows an example of a bracket blank, from which the bracket 10 can be manufactured. The blank can be made, for example, by water or laser cutting, or by stamping. A stiff bracket 10 can be manufactured by bending from a single plate piece 18. This will simplify the manufacture of the bracket 10. The plate piece 18 can be of a uniform thickness throughout. The plate piece 18 is easy to cut into the shape of the bracket 10 blank and few bends in the blank are needed to form the finished bracket 10. As an operation, bending is simple and cheap to arrange, compared, for example, to extrusion or moulding. In FIG. 8, the bends are shown by broken lines drawn on the plate piece 18.

In addition to a cantilever system, the invention also relates to a bracket 10 itself for the cantilever system. The bracket 10 can be installed in a profile rail 11. The profile rail 11 includes an elongated opening 12 for the bracket 10, opposing counter-surfaces 13, 14 arranged inside the profile rail 11 for pulling and pushing, which the bracket 10 is arranged to cause when installed in the profile rail 11. The bracket 10 includes a widening 15 to be fitted inside the profile rail 11, to which widening a pulling surface 16 is arranged for creating the said pulling when the bracket 10 is installed in the opening 12 of the profile rail 11, and a pushing surface 17 for creating the said pushing when the bracket 10 is installed in the opening 12 of the profile rail 11. The cross-section of the bracket 10 is in the part that it outside the profile rail 11, at least locally a sideways opening U-profile, when the bracket 10 is installed in the profile rail 11. In addition, the bracket is manufactured from a single plate piece 18 by bending.

Figure 9A:
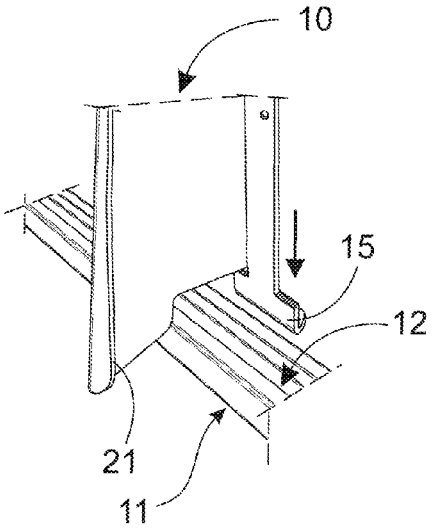
FIGS. 9*a*-9*e* show in stages the installation of the bracket in the profile rail.
Figure 9B:
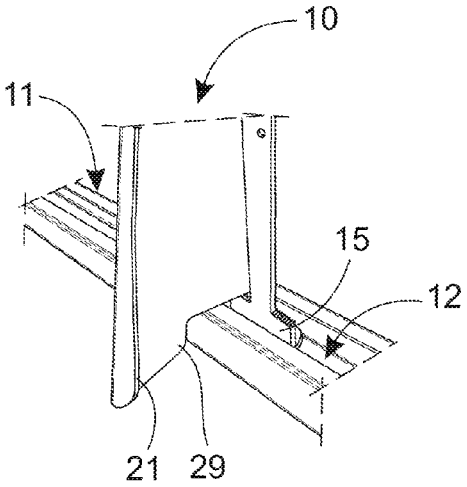

FIGS. 9*a*-9*e* show the operation of the system in stages, installing the bracket 10 in the profile rail 11, removing it, and moving it in the longitudinal direction L of the profile rail 11. The installation of the bracket 10 in the profile rail 11 is commenced by placing the bracket 10 in front of the profile rail 11 perpendicularly to the position in which the bracket is installed in the profile rail 11. FIG. 9*a* shows this setup. The widening 15 and the locking flange 28 are in such a way that they can be pushed into the profile rail 11 through the opening 12. FIG. 9*b* shows the situation in which this is happening.

Figure 9C:
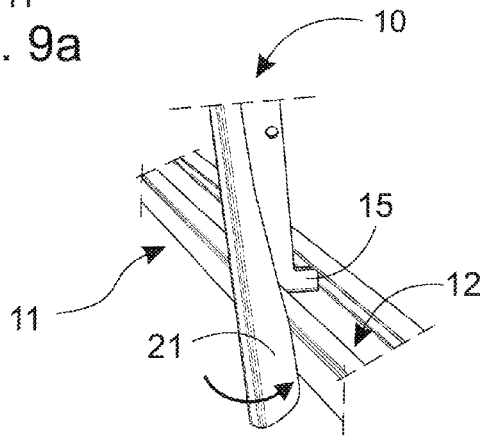

Once the widening 15 is inside the profile rail 11, the bracket 10 is next rotated in such a way that the lower flange 20 too is brought onto the same line as the opening 12. The front edge, in which are the pulling surfaces 16 of the bracket 10, and which is inside the profile rail 11 and fitted to the widening 15, can act as the rotational axis. FIG. 9*c* shows this rotation stage. At the same time as the bracket 10 is rotated, it can also be turned, so that the extension 29 fitted to the web 22 is brought in front of the opening 12. This turning too can take place with the pulling surfaces 16 of the widening 15 acting as an imaginary rotational axis. In the turning, the point 33 of the bracket 10 thus rises upwards.

Figure 9D:
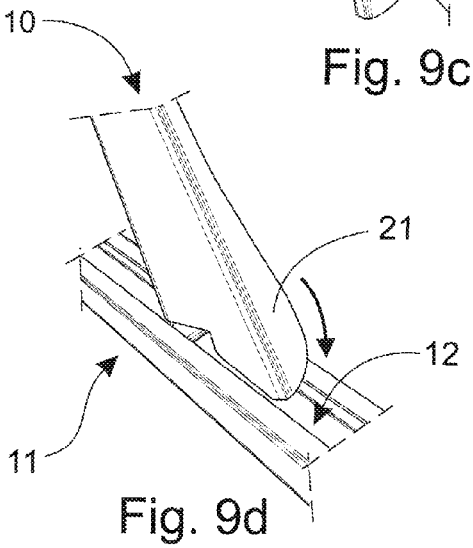

The situation shown in FIG. 9*d* is the result of the rotation and turning. In this position, the bracket 10 can be moved in both directions in the longitudinal direction L of the profile rail 11. For their part, the rotation and turning are permitted by the dimensioning of the widening 15 and locking flange 28 and the shaping of the locking flange 28. They permit the bracket 10 to be rotated by 90 degrees to the side when the widening 15 and the flange 28 are inside the profile rail 11. In addition, they also permit them to be pulled out of the profile rail 11, if the bracket 10 is raised to the upper position. The extension 29 of the lower flange 20 together with its friction surfaces 17 is then outside the front side of the profile rail 11, i.e. at the side of the profile rail 11.

Next, the bracket 10 is turned downwards, which turning once again takes place with the pulling surfaces 16 of the widening acting as the imaginary rotation axis. In the turning, the point 33 of the bracket 10 moves downwards. As a result of the turning, the edge of the extension 29 of the web 22, that is the rear edge of the bracket 10, reaches the opening 12 in the profile rail 11 and the extension 29 pushes into the opening 12. Then also the local widening 21 fitted to the lower flange 20 of the bracket 10 begins to correspond to the edge 30.2 of the opening 12 and the support surface 31 fitted to the extension 29 the opposite edge 30.1 of the opening 12. As the local width d of the bracket 10 is, at the widening 21, slightly larger than the width W of the opening, the bracket 10 become squeezed and some force must be used upon it, so that it can be twisted, in the case of the lower flange 20, between the gap formed in the opening 12 and thus into compression. The lower flange 20 and the local widening 21 arranged in it being principally non-deforming, the profile rail 11 flexes and acts elastically. As a result of this, the local widening 21 of the bracket 10 can enter the opening 12 in the profile rail 11 and also remain compressed by it.

When the bracket 10 is turned further, the pushing surface 17 fitted to the bracket 10 reaches the inner surface 37 of the rear wall of the profile rail 11, which acts as a counter-surface 14 to the pushing surface 17. Correspondingly, due to the relative positions and dimensions of the bracket 10 and the pulling and pushing surfaces 16, 17 fitted to it, the pulling surfaces 16 of the bracket 10 settle against the inner surface 35 of the front wall 34 of the profile rail 11. The result is the situation shown in FIG. 9*e*. The bracket 10 is then in place wedged in the profile rail 11 against profile rail's 11 front and rear wall's 34, 36 inner surfaces 35, 37 through the effect of the friction force caused by the loading force of the bracket 10, and thus they prevent the bracket 10 from moving in the longitudinal direction L of the profile rail 11.

Figure 9E:
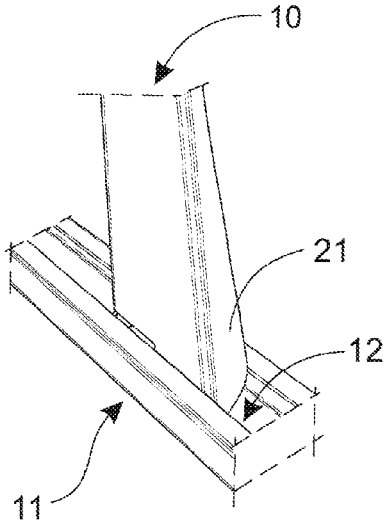

If it is desired to change the location of the bracket 10 placed in the profile rail 11 in the longitudinal direction L of the profile rail 11, then the bracket 10 is released by turning it upwards from the front edge 33 from the starting situation of FIG. 9*e*. As a result of the turning, the lower flange 20 is released from the compression formed by the opening 12 and the result is the situation according to FIG. 9*d*. In it, the lower flange 20 and also its extension 29 are outside the profile rail 11. When the friction force between the pushing surfaces 16, 17 and their counter-surfaces 13, 14 is lost, the position of the bracket 10 can be adjusted steplessly in the profile rail 11.

When it is at a suitable angle relative to the profile rail 11, the bracket 10 can once again be moved in the longitudinal direction of the profile rail 11. The possible locking flange 28 is then slightly off the inner surface 37 of the rear wall 36 of the profile rail 11 and a small gap remains between the widening 15, the flange 28, and the inner surfaces 35, 37 of the profile rail 11. This permits the movement of the bracket 10 in the profile rail 11, the widening 15 being inside it. When the bracket 10 is desired to secure again to the profile rail 11, it only needs to be turned back in the opposite direction from that in which it was released. Again the result is the situation shown in FIG. 9*e*.

In addition to the bracket 10 being able to be released, it can also be detached from the profile rail 11 at any point at all in the profile rail 11. The bracket 10 can be detached from the profile rail 11 in the opposite sequence to that when it was installed in it. The bracket 10 is then raised upwards from its front point 33, as a result of which the lower flange 20 is released as described above from the compression created on it by the opening 12. Next, the bracket 10 is turned by still lifting it from the front point 33, when the extension 29 of the web 22 rises completely out of the opening 12 (FIG. 9*d*). Once this has been achieved, the bracket 10 is then turned through 90° (FIG. 9*c*). The extension 29 of the web 22 then moves to beside the profile rail 11 (FIG. 9*b*). The widening 15 of the bracket 10 together with the locking flange 28 then ends up in such a position relative to the opening 12 of the profile rail 11 that it can be pulled out of the opening 12 of the profile rail 11 and the bracket 10 can then be detached from the profile rail 11.

Equally, the bracket 10 can, of course, be installed in the profile rail 11 by sliding it also from its ends, and can also be removed from the profile rail 11 in this way. The lateral rotation of the bracket 10 is then entirely eliminated.

Yet another way to ensure the placing of the bracket 10 in the longitudinal direction of the profile rail 11 is, for example, to drill holes in the rear wall 36 of the profile rail 11. The serrated point 23 in the lower part of the web 22 of the bracket 10, i.e. the pushing surface 17, then comes in contact with a hole, preventing the vertical movement of the bracket 10 and thus locking the bracket 10 in place. Stated more generally, the rear wall 36 of the profile rail 11 can be equipped with a grip arrangement for the pushing surface 17 of the bracket 10 to attach the bracket 10 in place in the longitudinal direction L of the profile rail 11. Though this permits the automatic locking of the bracket 10, at the same time the possibility of adjusting the bracket 10 is limited to being stepped according to the intervals of the holes. Locking can also be arranged by drilling holes in at least one front wall 34 of the profile rail 11. The front edge of the widening 15 of the bracket will then lock into a hole.

The cantilever system according to the invention, which is adjustable steplessly and can be locked and is to be attached, for example, to a vertically arranged profile rail 11, can be utilized, for example, as protruding shelf bracket system. The system will then include one or more profile rails 11 to be installed in a vertical direction and one or more brackets 10. The shelf system can be attached to a wall or free-standing.

According to another embodiment, the invention can also be applied in several other bracket applications. One of these that can be referred to as an example is, for instance, air-heat-pumps or air-conditioning equipment. In that case, the holes in the upper flange 19 can be elongated, so-called oblong holes. In addition, the bracket 10 can be used as a support for an adjustable work-bench or table.

According to yet another embodiment, one or several openings (not shown) can be arranged in the web 22 of the bracket for attaching cantilevered objects to the bracket 10. In addition, the bracket 10 will then also be lighter. The openings can be, for example, for suspending objects. A few examples of such suspended objects can be a clothes rail or clothes hangers. The at least local U-profile form of the cross-section of the bracket 10 also permits this application, nor will the bracket 10 be allowed to bend.

The length L of the bracket 10, i.e. its protrusion from the profile rail 11 can vary to even a great extent. It can be arranged to act even as only a hanging hook. The length of the upper flange 19 of the bracket 10 can then be only a few centimeters. The upper flange 19 can bent upwards at its front point, thus forming a hanging hook. In addition, in the hook embodiment the front point of the web 22 can be bent towards the direction in which the U-profile opens. In the hook embodiment, the most of the cross-section of the bracket 10 is a U-profile in the longitudinal direction L of the bracket 10.

The material thickness of the plate of the bracket 10, the web 22, the flanges 19, 20, and the widening 15 can be dimensioned ideally, in which case they will break at the same time.

It must be understood that the above description and the related figures are only intended to illustrate the present invention. The invention is thus in no way restricted to only the embodiments disclosed or stated in the Claims, but many different variations and adaptations of the invention, which are possible within the scope on the inventive idea defined in the accompanying Claims, will be obvious to one skilled in the art.

The invention claimed is:

1. A cantilever system, comprising:

at least one profile rail including an inside region and an elongated opening for receiving an end of a bracket for installation on the profile rail, and opposing counter-surfaces arranged in the inside region of the profile rail for receiving pulling and pushing which the bracket is arranged to cause when installed on the profile rail for providing friction force, which holds the bracket in place in the longitudinal direction of the profile rail; and at least one bracket comprising a single plate piece having bends, defining in a region outside the profile rail when the bracket is installed in the profile rail, a U-shape cross-section having a sideways facing opening when the bracket is installed in the profile rail, a widening to be fitted inside the profile rail and arranged to present a pulling surface to create the pulling when the bracket is installed in the opening in the profile rail, and a pushing surface to create the pushing when the bracket is installed in the opening in the profile rail;

wherein the U-shaped cross-section comprises:

an upper flange arranged as an extension of the widening;

a lower flange on an opposite side of the bracket to the upper flange, arranged in the bracket at least in a part that is outside the profile rail when the bracket is installed in the profile rail; and a straight web arranged between the upper flange and the lower flange.

2. The cantilever system according to claim 1, wherein the lower flange and the profile rail are dimensioned so that, when the bracket is installed in the profile rail, the bracket is arranged to remain, at said lower flange, in compression formed by edges of the opening.

3. The cantilever system according to claim 1, wherein the lower flange comprises a local widening arranged at a location of the opening of the profile rail when the bracket is installed in the profile rail.

4. The cantilever system according to claim 1, wherein the lower flange is arranged to extend inside the profile rail when the bracket is installed in the profile rail.

5. The cantilever system according to claim 1, wherein the pushing and pulling surfaces of the bracket each include a gripping shaping to increase a grip with respect to the opposing counter-surfaces of the profile.

6. The cantilever system according to claim 1, wherein the web of the bracket is arranged to extend at least partly to the profile rail when the bracket is installed in the profile rail.

7. The cantilever system according to claim 1, wherein the bracket comprises a locking mechanism to lock the bracket in place in the profile rail.

8. The cantilever system according to claim 7, wherein the locking mechanism is fitted to the widening.

9. The cantilever system according to claim 7, wherein the locking mechanism is arranged to wedge the pulling and pushing surfaces of the bracket against the counter surfaces of the profile rail.

10. The cantilever system according to claim 7, wherein the locking mechanism comprises:

a bend arranged in the widening to define a flange; and a locking element fitted to the flange.

11. The cantilever system according to claim 1, wherein a width of the upper flange is arranged to be greater than a width of the lower flange over most of a length of the bracket.

12. The cantilever system according to claim 1, wherein a lower part of the web of the bracket includes an extension extending inside the profile rail, when the bracket is installed in the profile rail, wherein the extension presents a support surface lying against a first edge of the opening.

13. The cantilever system according to claim 12, wherein a part of the web between the extension and the widening is arranged to remain outside the profile rail when the bracket is installed in the profile rail.

14. The cantilever system according to claim 3, wherein the web includes an edge at a location of the local widening, and which is mainly perpendicular relative to the edges of the opening in the profile rail, when the local widening arranged in the bracket is set to a compression formed by the edges of the opening.

15. The cantilever system according to claim 1, wherein the upper flange comprises holes to attach a cantilevered object to the bracket.

16. The cantilever system according to claim 1, wherein the web comprises one or more openings to either attach cantilevered objects to the bracket, to lighten the bracket or both.

17. The cantilever system according to claim 1, wherein the bracket is arranged to have the U-shape cross-section at least in an area of a root of the bracket when the bracket is installed in the profile rail.

18. The cantilever system according to claim 3, wherein the U-shape cross-section of the bracket is arranged at least in an area of the local widening.

19. The cantilever system according to claim 1, wherein the profile rail is in cross-section a C-profile, which comprises an elongated opening, front walls on each side of the opening having inner surfaces each arranged to present a respective counter-surfaces for the pulling caused by the bracket and a rear wall on an opposite side to the front walls and having an inner surface arranged to present the counter-surface for the pushing caused by the bracket.

20. The cantilever system according to claim 1, wherein the profile rail has a sufficient material thickness to be principally non-deforming in use.

21. The cantilever system according to claim 1, wherein the profile rail comprises a rear wall including a grip arrangement for the pushing surface of the bracket in order to secure the bracket in place in the longitudinal direction of the profile rail.

22. A bracket for a cantilever system for installation in a profile rail having an elongated opening for the bracket and opposing counter-surfaces arranged in an inside region of the profile rail for pulling and pushing of the bracket when the bracket is installed in the profile rail for providing friction force, which holds the bracket in place in the longitudinal direction of the profile rail, the bracket comprising:

a single plate piece having bends, defining in a region outside the profile rail when the bracket is installed in the profile rail, a U-shape cross-section having a sideways facing opening when the bracket is installed in the profile rail and comprising a widening to be fitted inside the profile rail and arranged to present a pulling surface to create the pulling when the bracket is installed in the opening in the profile rail and a pushing surface to create the pushing when the bracket is installed in the opening in the profile rail;

wherein the U-shaped cross-section comprises:

an upper flange arranged as an extension of the widening;

a lower flange on an opposite side of the bracket to the upper flange, arranged in the bracket at least in a part that is outside the profile rail when the bracket is installed in the profile rail; and a straight web arranged between the upper flange and the lower flange.

* * * * *